US009469153B2

(12) United States Patent
Zamarripa

(10) Patent No.: US 9,469,153 B2
(45) Date of Patent: Oct. 18, 2016

(54) PAINT TRAY WITH DISPOSABLE LINER SYSTEM

(71) Applicant: POLY TRAY SYSTEMS INC., Surrey, British Columbia (CA)

(72) Inventor: Javier Mora Zamarripa, Burnaby (CA)

(73) Assignee: Poly Tray Systems Inc., Burnaby BC. (CA)

( * ) Notice: Subject to any disclaimer, the term of this patent is extended or adjusted under 35 U.S.C. 154(b) by 0 days.

(21) Appl. No.: 14/556,459

(22) Filed: Dec. 1, 2014

(65) Prior Publication Data

US 2016/0152068 A1 Jun. 2, 2016

(51) Int. Cl.
*B65D 25/16* (2006.01)
*B44D 3/12* (2006.01)
*B05C 21/00* (2006.01)

(52) U.S. Cl.
CPC ..... *B44D 3/126* (2013.01); *B65D 25/16* (2013.01); *B05C 21/00* (2013.01)

(58) Field of Classification Search
CPC ..... B44D 3/126
USPC ..... 220/570, 571.1, 495.02, 495.11, 495.08
See application file for complete search history.

(56) References Cited

U.S. PATENT DOCUMENTS 2,922,176 A * 1/1960 Bernhardt ..... 15/257.06
4,541,542 A * 9/1985 Florentino ..... 220/570
5,460,289 A * 10/1995 Gemmell ..... 220/495.02
2004/0074907 A1* 4/2004 Gardner ..... 220/495.11
2004/0074908 A1 4/2004 Hong
2004/0112902 A1 6/2004 Campbell
2004/0134917 A1* 7/2004 Carnegie ..... 220/570
2004/0217242 A1* 11/2004 Foreman ..... 248/210
2006/0037960 A1* 2/2006 Rosa ..... 220/495.02
2007/0246474 A1 10/2007 Wallace
2009/0050632 A1* 2/2009 Martin ..... 220/570
2011/0168718 A1* 7/2011 Tsai et al. ..... 220/495.08
2011/0297685 A1* 12/2011 Sorenson ..... 220/570
2014/0197173 A1 7/2014 Morla
2014/0260105 A1 9/2014 Smith

FOREIGN PATENT DOCUMENTS

CA 2598236 A1 2/2009

* cited by examiner

*Primary Examiner* — J. Gregory Pickett
*Assistant Examiner* — Niki M Eloshawy
(74) *Attorney, Agent, or Firm* — Lisa Sim; Miller Thompson LLP.

(57) ABSTRACT

A paint tray with disposable liner system generally comprises two components, a paint tray base, and a liner holding frame which cooperatively engages with the paint tray base to securely hold a paint tray liner therebetween so as to position the paint tray liner overtop of the interior surface of the paint tray base. The paint tray base has a bumper extending around the periphery of the paint tray base from the exterior surface of its walls. The liner holding frame is sized to slidingly fit onto the paint tray base and engage the bumper, wherein engagement of the liner holding frame with the bumper securely fixes a paint tray liner in place therebetween. A cover can optionally be included in the system that includes a cover holding frame sized to fit on top of the paint tray base above the liner holding frame, wherein the cover holding frame comprises a channel to receive a top end of a corresponding wall of the paint tray base to securely fix the paint tray cover in place therebetween.

18 Claims, 10 Drawing Sheets

PAINT TRAY WITH DISPOSABLE LINER SYSTEM

FIELD OF THE INVENTION

The present invention relates to the field of paint trays for use with a paint roller in applying paint to a surface and, in particular, to a paint tray having a disposable liner.

BACKGROUND OF THE INVENTION

Paint trays are conventionally used in the painting industry to allow a paint roller to be evenly loaded with paint for application to a surface. Paint trays are typically rectangular with a deep well at one end and a ridged inclined portion leading into the well. The well holds the paint for the roller to be dipped into and rolled out over the ridged, inclined portion to uniformly distribute the paint to the roller. After use, the paint tray must be cleaned to remove the unused paint to avoid contaminating a later painting project. Cleaning a paint tray, however, can be messy and difficult to achieve due in part to the ridges that are found in most commercial paint trays.

To facilitate paint tray cleanup, molded disposable paint tray liners have been developed that fit into the rigid paint trays. While this solution allows re-use of the rigid paint trays, these thin plastic molded tray liners often do not fit well into the rigid paint trays. Moreover, the pre-formed shape of the liners often get bent and twisted when trying to fit the liner into a rigid paint tray. These bends can allow paint to leak into the rigid paint tray or make removing excess paint from the paint roller more difficult. United States Patent Publication No. 2009/0050632 describes an example of such a paint tray system that includes a pre-formed plastic paint tray liner that conforms to the inside surface of the paint tray. The liner is held in place within the paint tray by a peripheral liner lip which extends over the land of the tray and four corner holes for receiving four corner dowels of the tray for holding the liner in place.

The molded pre-formed design of these paint tray liners can be costly to produce and can be prohibitively expensive to use for single use purposes. As a result, attempts are commonly made by users to clean and re-use the paint tray liners for multiple use before disposal, thereby, defeating the purpose of using a paint tray liner.

Other solutions include wrapping plastic wrap or foil over the top of the rigid paint tray to prevent cross-contamination. While these methods can work, and are relatively inexpensive, they can be time-consuming to set up and messy to dispose of.

United States Patent Publication No. 2014/0260105 describes a paint tray liner formed into a bag to facilitate set-up. United States Patent Publication No. 2014/0197173 describes a paint tray liner cover held in place over a paint tray by an elasticized band sewn into the circumference of the cover. Other paint tray liners have been developed with adhesives to hold the paint tray liner in place during use. For example, United States Patent Publication No. 2007/0246474, 2006/0037960, and 2004/0112902. While less expensive than pre-formed molded paint tray liners, these specially-designed liners can still be expensive for single use. As well, these liners can be awkward and time consuming to fit into a paint tray.

As can be seen, there is a continuing need for a paint tray having an inexpensive, easy to apply, disposable paint tray liner that can be properly fitted over a rigid paint tray, and that can be easily removed and disposed of, without interfering with the function of the rigid paint tray.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

Disclosed herein are exemplary embodiments pertaining to a paint tray with disposable liner system. In accordance with one aspect of the invention, there is described a paint tray with disposable liner system, comprising: a paint tray base having a pair of opposed side walls, a pair of opposed end walls, and a floor defining an interior surface for containing and distributing paint received in said paint tray base, said paint tray base having a bumper extending around the periphery of the paint tray base from the exterior surface of the walls; and a liner holding frame having a pair of opposed side walls and a pair of opposed end walls sized to slidingly engage with the paint tray base to securely fix a paint tray liner in place therebetween, wherein the paint tray liner is held in place to cover the interior surface of the paint tray base.

According to certain exemplary embodiments, the paint tray with disposable liner system described herein further comprises a paint tray liner sized to cover the interior surface and extend over the walls of the paint tray base so as to allow the paint tray liner to be held in place between said paint tray base and said liner holding frame.

In accordance with another aspect, there is described a paint tray with disposable liner system, comprising: a paint tray base having a pair of opposed side walls, a pair of opposed end walls, and a floor defining an interior surface for containing and distributing paint received in said paint tray base, said paint tray base having a bumper extending around the periphery of the paint tray base from the exterior surface of the walls; and a liner holding frame having a pair of opposed side walls and a pair of opposed end walls sized to slidingly fit onto the paint tray base and engage said bumper, wherein engagement of said liner holding frame with said bumper securely fixes a paint tray liner in place therebetween, wherein the paint tray liner is held in place to cover the interior surface of the paint tray base.

According to certain exemplary embodiments, the paint tray with disposable liner system described herein, further comprises a paint tray liner sized to cover the interior surface and extend over the walls of the paint tray base so as to allow the paint tray liner to be held in place between said paint tray base and said liner holding frame.

In accordance with another aspect, there is described a paint tray with disposable liner system, comprising: a paint tray base having a pair of opposed side walls, a pair of opposed end walls, and a floor defining an interior surface for containing and distributing paint received in said paint tray base, said paint tray base having a bumper extending around the periphery of the paint tray base from the exterior surface of the walls; a liner holding frame having a pair of opposed side walls and a pair of opposed end walls sized to slidingly fit onto the paint tray base and engage said bumper, wherein engagement of said liner holding frame with said bumper securely fixes a paint tray liner in place therebetween; and a cover holding frame having a pair of opposed side walls and a pair of opposed end walls and sized to fit on top of the paint tray base above the liner holding frame, wherein the walls of said cover holding frame comprise an inner wall and an outer wall connected at a top end to form a channel to receive a top end of a corresponding wall of the paint tray base to securely fix the paint tray cover in place therebetween.

According to certain exemplary embodiments, the paint tray with disposable liner system, further comprises: a paint tray liner sized to cover the interior surface and extend over the walls of the paint tray base so as to allow the paint tray liner to be held in place between said paint tray base and said liner holding frame; and a paint tray cover sized to cover the paint tray base and liner holding frame engaged thereto so as to allow the paint tray cover to be held in place between said paint tray base and said cover holding frame.

BRIEF DESCRIPTION OF THE DRAWINGS

These and other features of the invention will become more apparent in the following detailed description in which reference is made to the appended drawings.

DETAILED DESCRIPTION OF THE INVENTION

Figure 1:
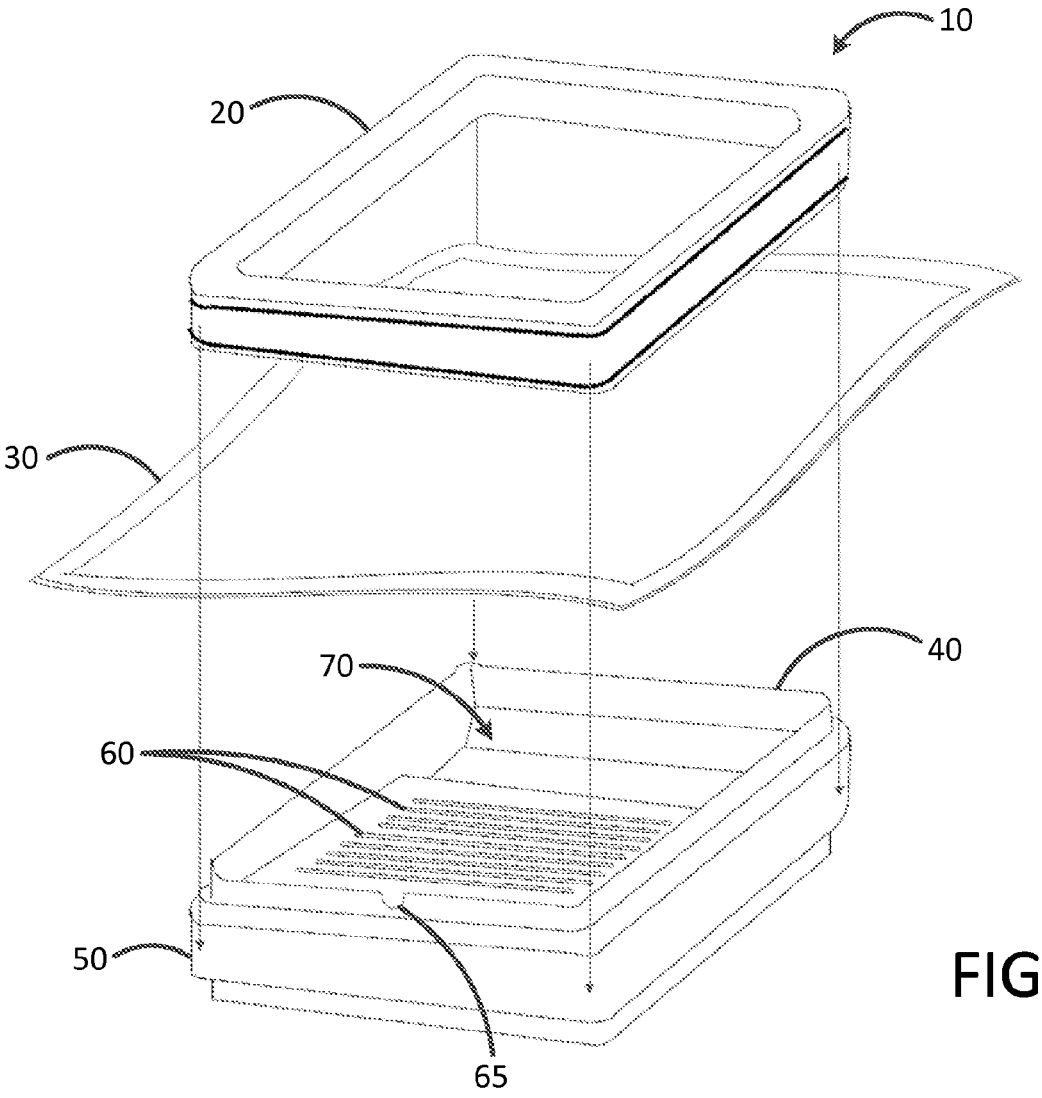
FIG. 1 is an exploded view of a paint tray with disposable liner system, according to one embodiment of the present disclosure.

The paint tray system according to embodiments described herein comprises two separable components which connect together to fix a disposable paint tray liner therebetween. In this way, a paint tray liner can be overlaid onto the interior surface of a paint tray and securely fixed in position to create a barrier for protecting the interior surface of the paint tray from paint dispensed into the paint tray for application onto a roller. When in use, the connected components of the paint tray system prevent the liner from moving or being displaced from the paint tray. After use, the two components can be easily separated to release the liner which can then be removed. Unused paint can be easily collected from the liner for reuse and the liner itself disposed.

According to embodiments, the paint tray liner is a flexible sheet that is substantially impermeable to paint. Being a flexible sheet simplifies application of the liner into the paint tray. The liner simply requires it to be overlaid onto the interior surface of the paint tray and the flexible nature of the liner then allows the liner to naturally conform to the shape of the paint tray. The flexible nature of the liner further facilitates clean-up after use since the edges of the sheet-type liner can be gathered together to pool any leftover paint into the center of the liner and simply lifted out of the paint tray for disposal.

The separable components of the paint tray system comprise a paint tray base and a correspondingly shaped liner holding frame. The liner holding frame is sized to fit with the paint tray base to engage the base in order to securely hold a paint tray liner therebetween. According to particular embodiments, the paint tray base comprises a bumper extending from the exterior walls of the base. The bumper, according to certain embodiments, engages with the liner holding frame which is sized to fit overtop of the bumper to securely hold a liner between the bumper of the paint tray base and the liner holding frame. According to other embodiments, the liner holding frame is configured with a peripheral channel sized to receive the top edge of the paint tray walls to securely hold a liner therein.

According to further embodiments, the paint tray system described herein can be adapted to have both a disposable liner system as well as a cover that can be easily applied and removed when needed so as to prevent the paint from drying out in between use. The paint tray cover comprises a cover holding frame which engages with the paint tray base to securely hold a cover sheet threrebetween and overtop of the opening of the paint tray.

DEFINITIONS

Unless defined otherwise, all technical and scientific terms used herein have the same meaning as commonly understood by one of ordinary skill in the art to which this invention belongs.

As used herein, the term "about" refers to an approximately +/−10% variation from a given value. It is to be understood that such a variation is always included in any given value provided herein, whether or not it is specifically referred to.

Embodiments of the present disclosure will now be described by reference to the Figures, which show exemplary representations of a paint tray with disposable liner system of the present disclosure.

Paint Tray Liner System—Liner Holding Frame

Figure 2:
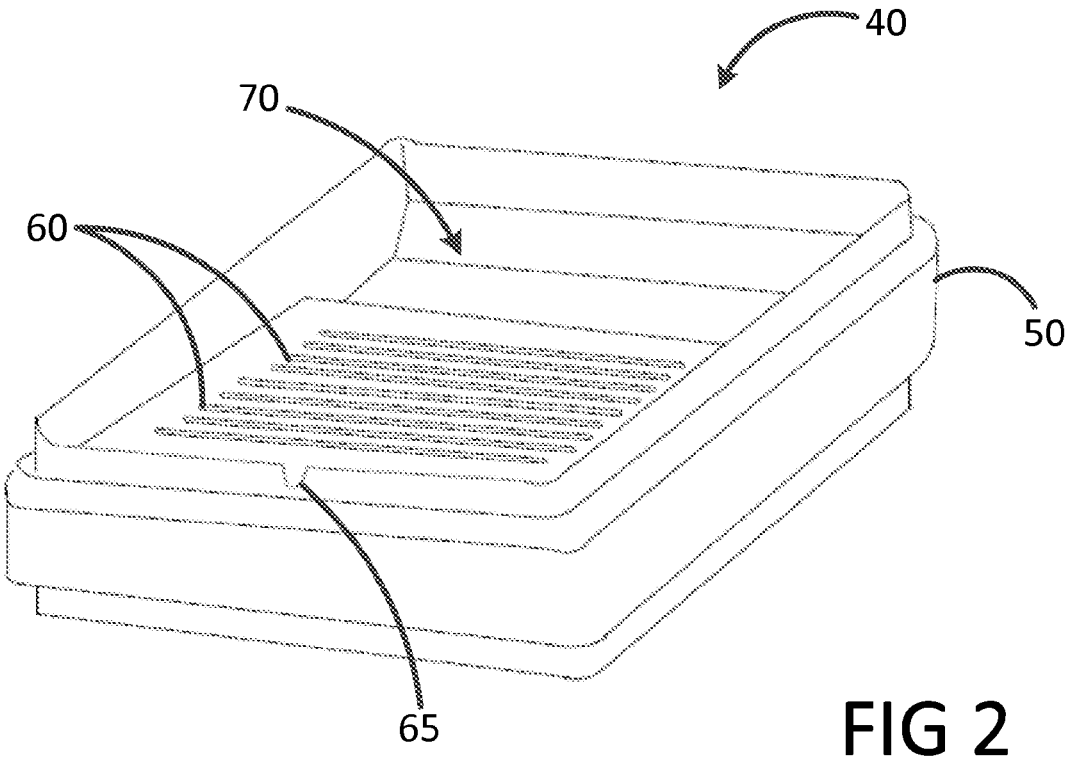
FIG. 2 is a perspective view of a paint tray base, according to embodiments of the present disclosure.

A paint tray with disposable liner system of the present disclosure generally comprises two components, a paint tray base 40, and a liner holding frame 20, 120 which cooperatively engages with the paint tray base 40 to securely hold a paint tray liner 30 therebetween. Referring to FIG. 2, the paint tray base 40 comprises a pair of opposed side walls, a pair of opposed end walls, and a floor defining an interior surface for containing and distributing paint received in the paint tray base 40. The interior floor surface of the paint tray base 40, according to embodiments of the present disclosure, has a ridged 60 and sloping portion extending from one of the end walls and terminating in a paint reservoir 70 at an opposite end wall.

According to embodiments, the exterior of the paint tray base 40 comprises a bumper 50 that extends around the periphery of the exterior surface of the paint tray base walls and below the top edge of the walls which extend above the interior surface of the paint tray base 40 to contain the paint dispensed within. According to certain embodiments, the top edge of the paint tray base can further comprise a notch 65 at its sloped end in order to allow a roller handle to rest therein during use. The bumper 50, as will be illustrated, cooperatively engages with a corresponding liner holding frame 20, 120 which slidingly engages with the paint tray base to securely hold a paint tray liner 30 placed therebetween.

Figure 3:
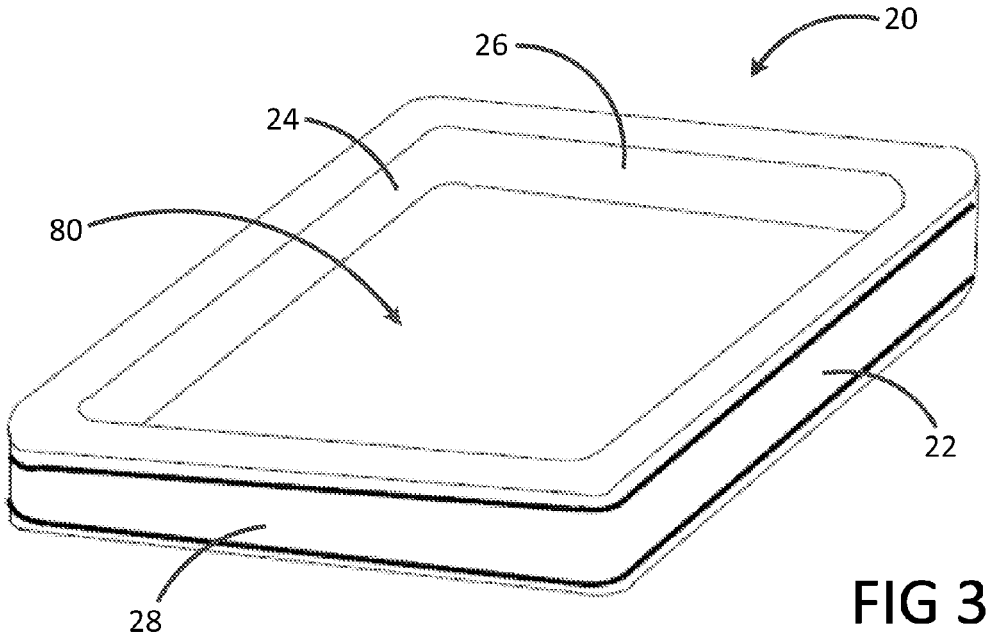
FIG. 3 is a perspective view of the liner holding frame shown in FIG. 1, according to one embodiment of the present disclosure.
Figure 4A:
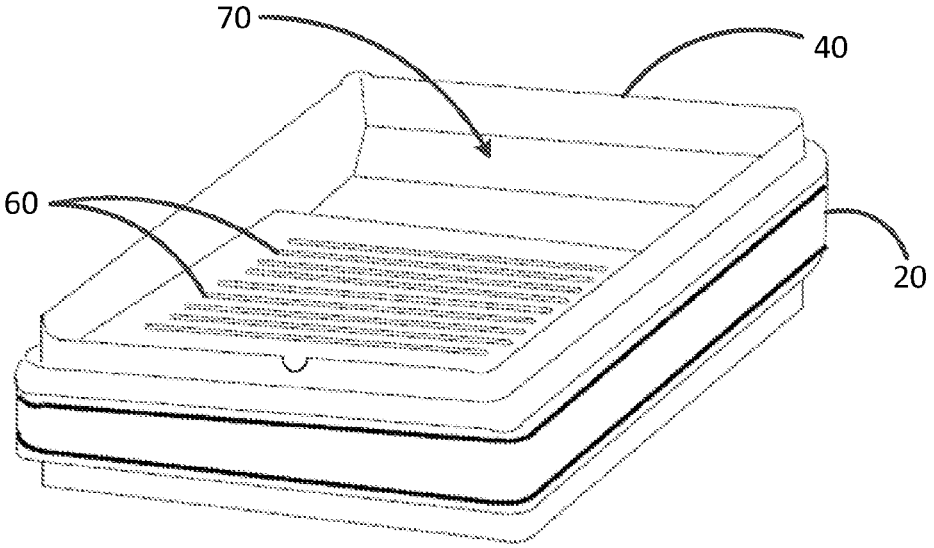
FIGS. 4A and 4B are perspective views of the liner holding frame shown in FIG. 3 in engagement with the paint tray base shown in FIG. 2, without a liner (FIG. 4A) and with a liner (FIG. 4B) secured therebetween, according to one embodiment of the present disclosure.
Figure 4B:
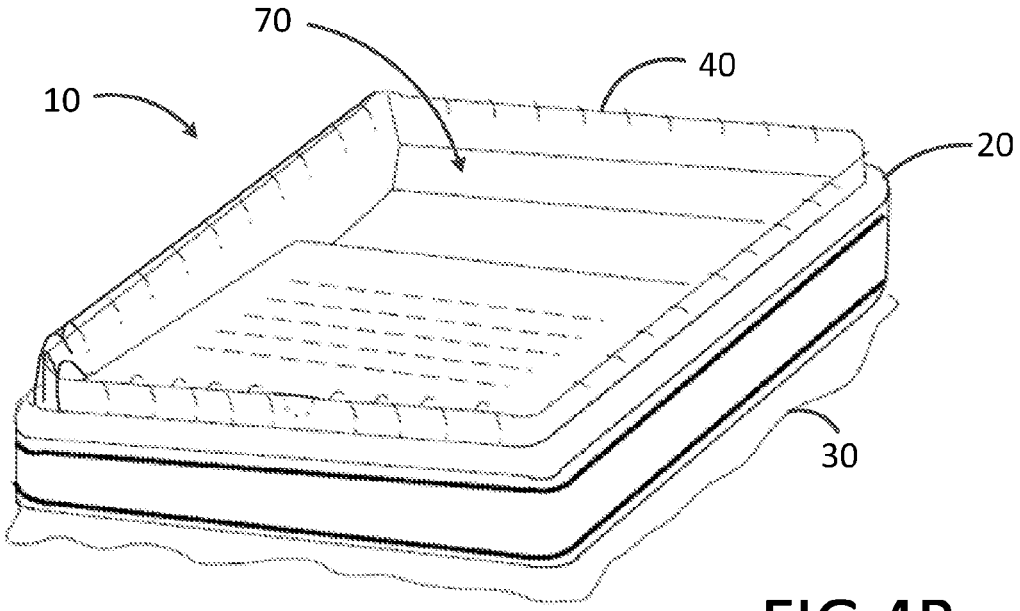

Referring to FIG. 3, the liner holding frame 20, according to certain embodiments, comprises a pair of opposed side walls 22, 24 and a pair of opposed end walls 26, 28 that form the frame 20 sized to slidingly fit overtop of the bumper 50 of the paint tray base 40 to securely fix a paint tray liner 30 in place therebetween (FIG. 4A). According to such embodiments, as illustrated in FIG. 1, a paint tray liner 30 is laid overtop of the interior surface of the paint tray base 40 so as to cover and conform to the entire interior surface of the paint tray base 40 and the interior walls of the base 40, and to sufficiently extend over the top edge of the walls of the paint tray base 40 so as to allow the liner 30 to be securely fixed between the liner holding frame 20 and the bumper 50 of the paint tray base 40 (FIG. 4B).

Figure 6:
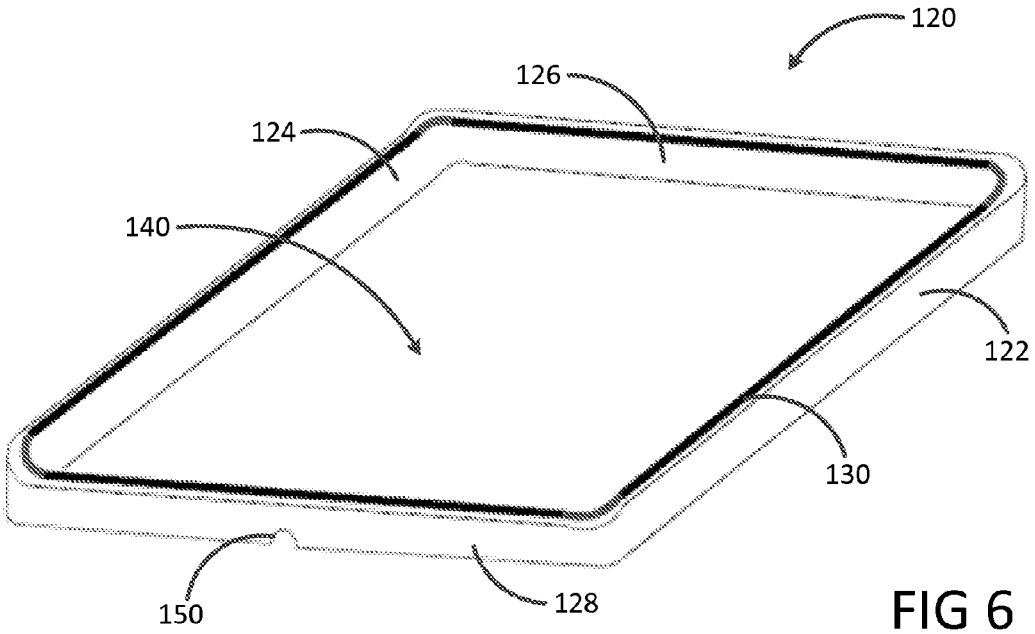
FIG. 6 is a perspective view of the liner holding frame shown in FIG. 5, according to embodiments of the present disclosure.
Figure 7A:
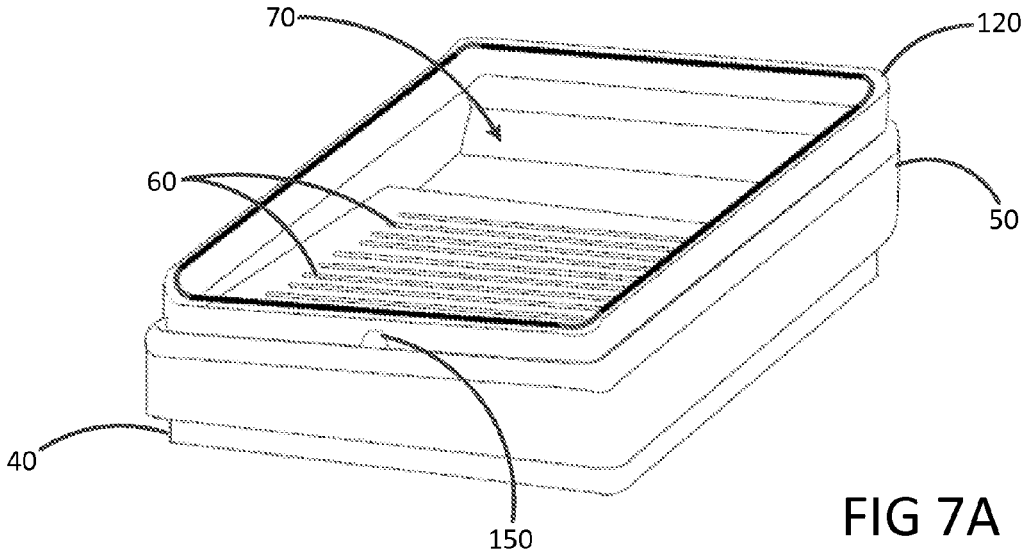
FIGS. 7A and 7B are perspective views of the liner holding frame shown in FIG. 6 in engagement with the paint tray base shown in FIG. 2, without a liner (FIG. 7A) and with a liner (FIG. 7B) secured therebetween, according to embodiments of the present disclosure.
Figure 7B:
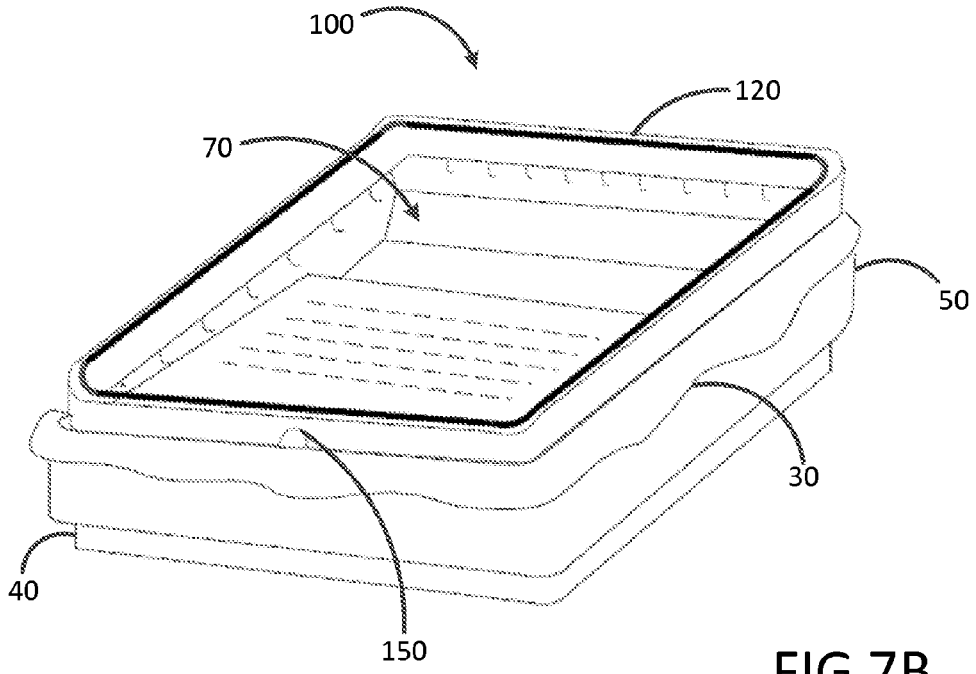

According to further embodiments, the liner holding frame 120 can be adapted to engage with the top edge of the of the paint tray base 40. In such embodiments, as shown in FIG. 6, the walls 122, 124, 126, 128 of the liner holding frame 120 comprise an inner wall and an outer wall connected at a top end 130 to form a channel for receiving the top edge of a corresponding wall of the paint tray base 40 (FIG. 7A). When affixed to the top edge of the paint tray base 40, the liner holding frame 120 forms a tight connection for securely fixing the paint tray liner 30 between the holding frame 120 and the paint tray base 40 within the channel (FIG. 7B).

Figure 5:
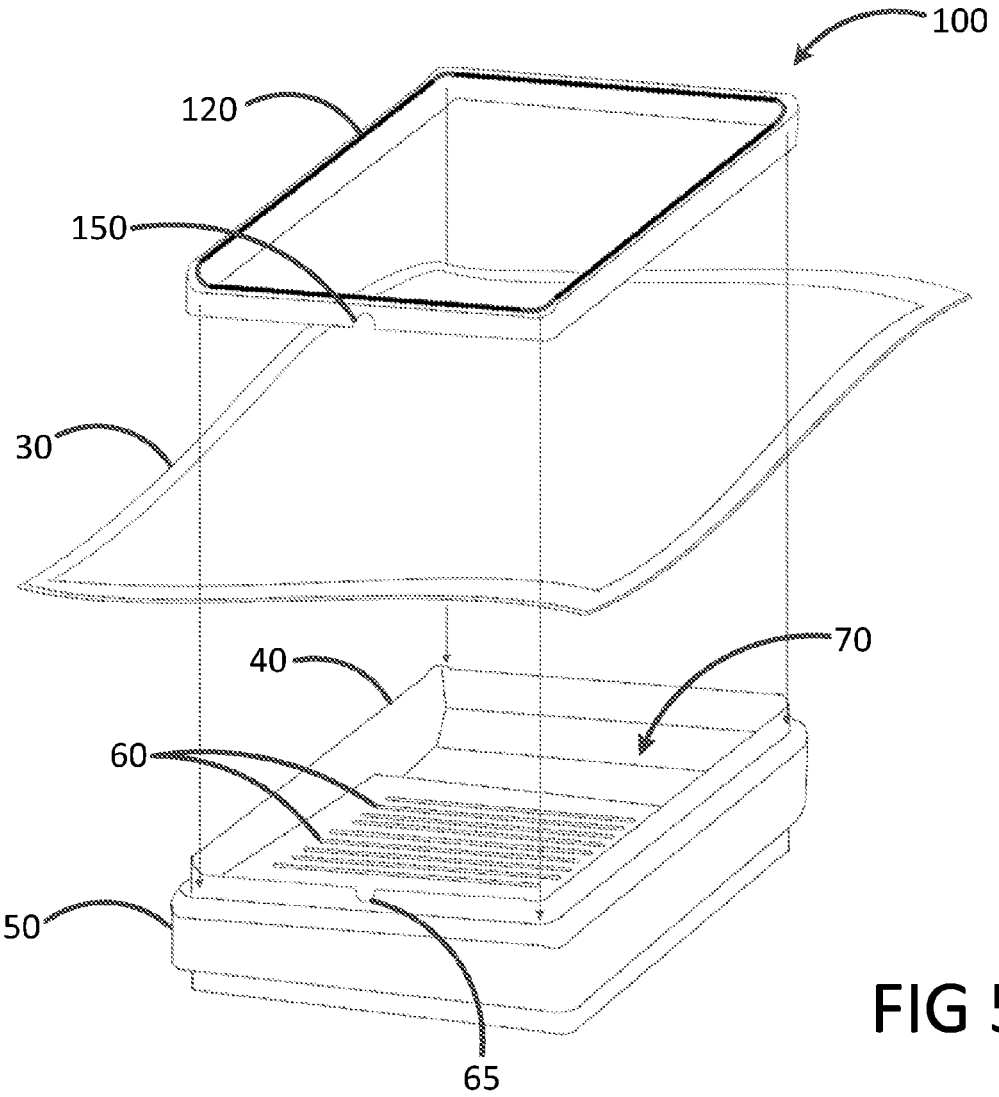
FIG. 5 is an exploded view of a paint tray with disposable liner system, according to a further embodiment of the present disclosure.

As shown in FIG. 5, when such embodiments are in use, a paint tray liner 30 is laid overtop of the interior surface of the paint tray base 40 to cover and conform to the entire interior surface of the paint tray base 40 and the interior walls of the base 40, and to sufficiently extend over the top edge of the walls of the paint tray base 40 so as to allow the liner 30 to be securely fixed between the liner holding frame 120 and the top edge of the paint tray base 40 within the channel 130 of the liner holding frame 120. According to such embodiments, the bottom edge of the liner holding frame 120 can further rest on the extensions provided by the bumper 50 of the paint tray base 40 for added stability.

According to such embodiments, the liner holding frame 120 can further comprise a notch 150 corresponding to the notch 65 in the paint tray base 40 in order to further accommodate the handle of a roller that can be securely set within the notches 65, 150 in between use.

Paint Tray Cover—Cover Holding Frame

Figure 8:
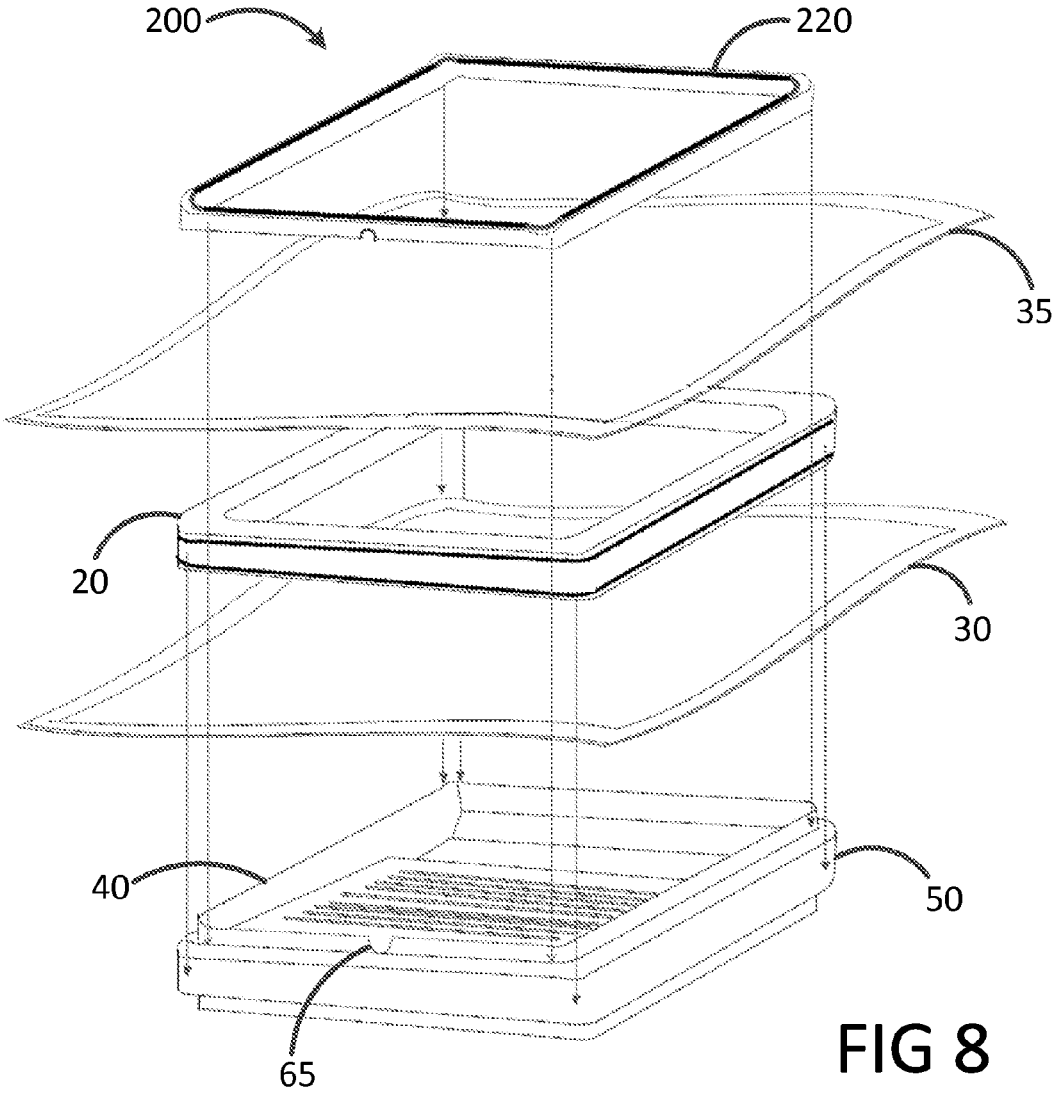
FIG. 8 is an exploded view of the paint tray with disposable liner system shown in FIG. 1 further having a paint tray cover comprising a cover sheet and a cover holding frame, according to embodiments of the present disclosure.
Figure 9:
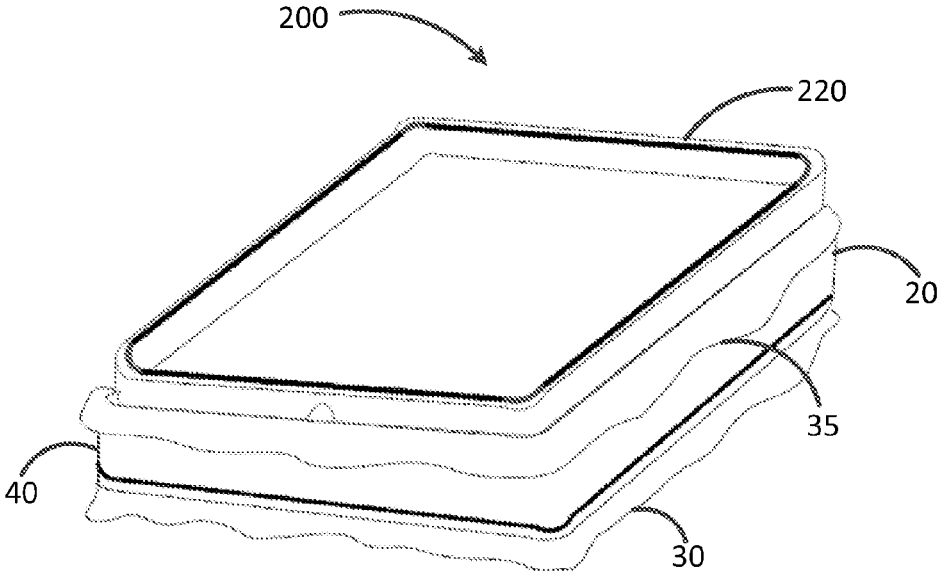
FIG. 9 is a perspective view of the paint tray with disposable liner system with paint tray cover shown in FIG. 8, according to embodiments of the present disclosure.

Referring to FIGS. 8 and 9, the paint tray with disposable liner system according to embodiments, can further comprise a paint tray cover that can be easily applied and removed when needed so as to prevent the paint from drying out in between use. According to such embodiments, the paint tray system 200 includes a paint tray base 40 and a liner holding frame 20 that engages with the bumper 50 of the paint tray base 40 to securely fix the liner therebetween in position overtop of the interior surface of the paint tray base 40. Because the liner holding frame 20 is sized to engage with the bumper 50, the liner holding frame 20 is positioned approximately midway along the wall of the paint tray base 40 thereby allowing a cover holding frame 220 to be affixed to the top edge of the paint tray base 40 wall to securely fix a cover sheet 35 in place overtop of the opening of the paint tray base 40.

According to such embodiments, the cover holding frame 220 can be interchangeably used as either a liner holding frame 120 as described in reference to FIGS. 5, 6, and 7 or the cover holding frame 220 shown in FIGS. 8 and 9. In this way, a single system offers versatility in how it may be used. For example, as described in reference to FIG. 1 and as shown in FIG. 8, a paint tray liner 30 is laid overtop of the interior surface of the paint tray base 40 so as to cover and conform to the entire interior surface of the paint tray base 40 and the interior walls of the base 40, and to sufficiently extend over the top edge of the walls of the paint tray base 40 so as to allow the liner 30 to be securely fixed between the liner holding frame 20 and the bumper 50 of the paint tray base 40. To cover the paint tray in between use, a cover sheet 35 can be similarly laid overtop of the opening of the paint tray and the cover holding frame 220 affixed to the top edge of the paint tray wall with the cover sheet 35 securely held in place between the top edge of the paint tray wall and the cover holding frame. As described in reference to FIGS. 5, 6, and 7, the walls of the cover holding frame 220 comprise an inner wall and an outer wall connected at a top end to form a channel for receiving the top edge of a corresponding wall of the paint tray base 40. When affixed to the top edge of the paint tray base 40, the cover holding frame 220 forms a tight connection for securely fixing the cover sheet 35 within the channel and between the holding frame 220 and the paint tray base 40.

Paint Tray Sheet—Paint Tray Liner and Paint Tray Cover

Figure 10:
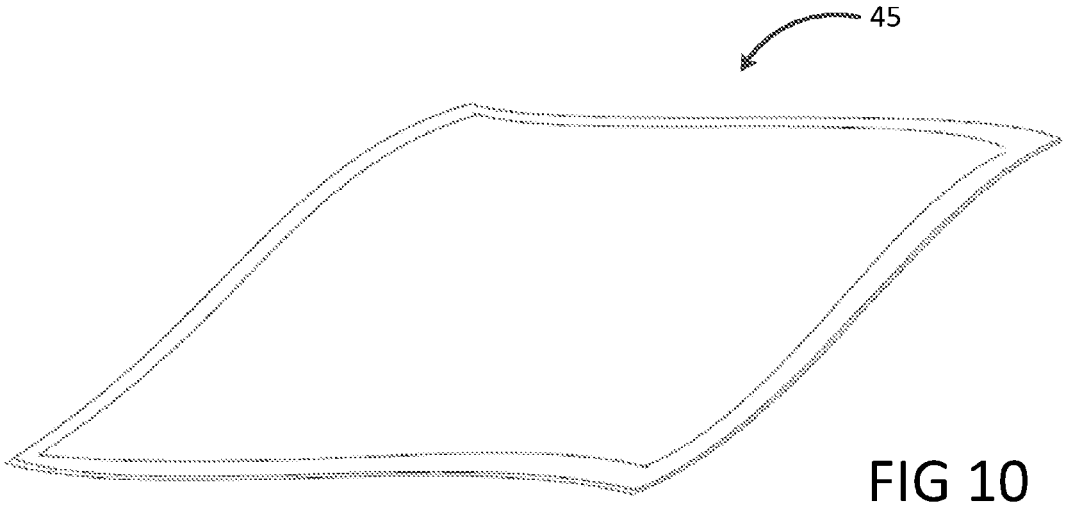
FIG. 10 is a perspective view of a paint tray sheet, according to embodiments of the present disclosure, which can be used as a paint tray liner or as a cover sheet as described herein.

The paint tray liner 30 and the cover sheet 35 used with the paint tray system described herein comprises a flexible sheet 45 (FIG. 10) which according to embodiments is typically made of a polymer material that is generally impervious to and non-reactive with paint materials, whether water-based, oil-based, or other synthetic-based paint. As thinner sheets will tend to be harder to work with and more susceptible to damage and tearing, certain embodiments may comprise multiple sheets 45. According to a particular embodiment, the sheet comprises two sheets 45 that together form a 2-ply liner 30. Irrespective of the number of layers, the final thickness of the sheet 45 will be such that the sheet's 45 ability to naturally conform to the shape of the paint tray and expose the ridges 60, bumps, and other shape irregularities of the tray, is maintained.

The use of a flexible sheet 45 as a paint tray liner and/or cover allows liners and covers to be made in an unlimited range of sizes to accommodate paint tray systems of varying sizes. Moreover, the uncomplicated design of the sheet 45 means that paint tray liners 30 and covers 35 can be made relatively inexpensively thereby encouraging users to actually dispose of the liners after use, rather than washing them as they would a conventional paint tray. As well, liners 30 and covers 35 used with systems of the present disclosure would produce less waste in comparison to other paint tray liners. According to certain embodiments, the sheet 45 can be further made of a biodegradable or compostable material.

The disclosures of all patents, patent applications, publications and database entries referenced in this specification are hereby specifically incorporated by reference in their entirety to the same extent as if each such individual patent, patent application, publication and database entry were specifically and individually indicated to be incorporated by reference.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

The embodiments of the invention in which an exclusive property or privilege is claimed are defined as follows:

1. A paint tray with disposable liner system, comprising:

a paint tray base having a pair of opposed side walls, a pair of opposed end walls that together form a top edge at one end of said paint tray base opposite to a bottom end of said paint tray base, the top edge and bottom end defining an exterior surface of the paint tray base extending therebetween, and a floor defining an interior surface for containing and distributing paint received in said paint tray base, said paint tray base having a bumper extending continuously along the exterior surface to form a protrusion around the entire exterior perimeter of the paint tray base about midway between the top edge and bottom end of said paint tray base; and a unitary liner holding frame having a pair of opposed side walls and a pair of opposed end walls sized to slidingly fit overtop of the bumper such that the liner holding frame is securely seated on the protrusion about midway between the top edge and bottom end of the paint tray base to securely fix a paint tray liner when said paint tray liner is disposed therebetween;

wherein when said paint tray liner is disposed therebetween, the paint tray liner is laid overtop of the interior surface of the paint tray base so as to cover and conform to the interior surface and the interior walls of the paint tray base, and to completely extend over the top edge of the paint tray base to overlay the protrusion situated about midway between the top edge and bottom end of the paint tray base so as to allow the paint tray liner to be securely fixed between the liner holding frame and the bumper of the paint tray base.

2. The paint tray with disposable liner system according to claim 1, wherein the interior floor surface comprises a ridged and sloping portion extending from one of said end walls and terminating in a paint reservoir at an opposite end wall.

3. The paint tray with disposable liner system according to claim 1, wherein the paint tray with disposable liner system further comprises the paint tray liner, said paint tray liner sized to cover the interior surface and completely extend over the top edge of the paint tray base and overlay the protrusion so as to allow the paint tray liner to be held in place between the bumper of said paint tray base and said liner holding frame.

4. The paint tray with disposable liner system according to claim 3, wherein said paint tray liner is a flexible sheet being substantially impervious to paint.

5. The paint tray with disposable liner system according to claim 4, wherein said paint tray liner is made of a polymer material.

6. The paint tray with disposable liner system according to claim 4, wherein said paint tray liner is a two-ply sheet.

7. The paint tray with disposable liner system according to claim 4, wherein said paint tray liner is biodegradable or compostable.

8. The paint tray with disposable liner system according to claim 1, further comprising a cover holding frame having a pair of opposed side walls and a pair of opposed end walls and sized to securely engage with the top edge of the paint tray base to sit above the liner holding frame seated on the protrusion of the paint tray base, wherein the walls of said cover holding frame comprise an inner wall and an outer wall connected at a top end to form a channel to receive the top edge of the paint tray base to securely fix a cover sheet when said cover sheet is disposed therebetween.

9. The paint tray with disposable liner system according to claim 8, wherein the paint tray with disposable liner system further comprises the paint tray liner, said paint tray liner sized to cover the interior surface and to completely extend over the top edge of the paint tray base and overlay the protrusion so as to allow the paint tray liner to be held in place between the bumper of said paint tray base and said liner holding frame; and the cover sheet, said cover sheet sized to overlay the paint tray base and extend over the top edge of the paint tray base so as to allow the cover sheet to be held in place between said top edge of the paint tray base and said cover holding frame.

10. The paint tray with disposable liner system according to claim 9, wherein the cover sheet is a flexible substantially airtight sheet.

11. A paint tray with disposable liner system, comprising:

a paint tray base having a pair of opposed side walls and a pair of opposed end walls that together form a top edge at one end of said paint tray base opposite to a bottom end of said paint tray base, the top edge and the bottom end defining an exterior surface of the paint tray base extending therebetween, and a floor defining an interior surface for containing and distributing paint received in said paint tray base, said paint tray base having a bumper extending continuously along the exterior surface to form a protrusion around the entire exterior perimeter of the paint tray base about midway between the top edge and bottom end of said paint tray base;

a unitary liner holding frame having a pair of opposed side walls and a pair of opposed end walls sized to slidingly fit overtop of the bumper such that the liner holding frame is securely seated on the protrusion about midway between the top edge and bottom end of the paint tray base to securely fix a paint tray liner when said paint tray liner is disposed therebetween; and a cover holding frame having a pair of opposed side walls and a pair of opposed end walls and sized to securely engage with the top edge of the paint tray base to sit above the liner holding frame seated on the protrusion of the paint tray base, wherein the walls of said cover holding frame comprise an inner wall and an outer wall connected at a top end to form a channel to receive the top edge a corresponding wall of the paint tray base to securely fix a cover sheet when said cover sheet is disposed therebetween.

12. The paint tray with disposable liner system according to claim 11, further comprising:

the paint tray liner, said paint tray liner sized to cover the interior surface and completely extend over the top edge of the paint tray base and overlay the protrusion so as to allow the paint tray liner to be held in place between the bumper of said paint tray base and said liner holding frame; and the cover sheet, said cover sheet sized to overlay the paint tray base and extend over the top edge of the paint tray so as to allow the cover sheet to be held in place between said top edge of the paint tray base and said cover holding frame.

13. The paint tray with disposable liner system according to claim 12, wherein said paint tray liner is a flexible sheet being substantially impervious to paint.

14. The paint tray with disposable liner system according to claim 13, wherein said paint tray liner is made of a polymer material.

15. The paint tray with disposable liner system according to claim 13, wherein said paint tray liner is a two-ply sheet.

16. The paint tray with disposable liner system according to claim 13, wherein said paint tray liner is biodegradable or compostable.

17. The paint tray with disposable liner system according to claim 12, wherein the cover sheet is a flexible substantially airtight sheet.

18. The paint tray with disposable liner system according to claim 11, wherein the interior floor surface comprises a ridged and sloping portion extending from one of said end walls and terminating in a paint reservoir at an opposite end wall.

* * * * *